United States Patent [19]

Raab

[11] Patent Number: 4,746,269

[45] Date of Patent: May 24, 1988

[54] SEAL COOLING FOR PLASTIC PUMPS

[75] Inventor: Alfred Raab, Brampton, Canada

[73] Assignee: Jacuzzi Inc., Little Rock, Ark.

[21] Appl. No.: 865,818

[22] Filed: May 22, 1986

[51] Int. Cl.[4] ..... F04D 29/10

[52] U.S. Cl. ..... 415/170 A; 415/177; 277/39

[58] Field of Search ..... 415/170 A, 173 R, 174, 415/175, 177, 180, 214; 277/38, 39, 81

[56] References Cited

U.S. PATENT DOCUMENTS

| | | | |
|---|---|---|---|
| 3,071,075 | 1/1963 | Spring | 415/170 A |
| 3,272,129 | 9/1966 | Leopold | 415/170 A |
| 3,554,661 | 1/1971 | Oglesby et al. | 415/175 X |
| 3,594,102 | 7/1971 | Oden | 415/170 A |
| 3,826,589 | 7/1974 | Frank et al. | 415/170 A |
| 4,380,416 | 4/1983 | Menager | 415/170 A |
| 4,548,547 | 10/1985 | Devring | 415/170 A |

FOREIGN PATENT DOCUMENTS

| | | | |
|---|---|---|---|
| 405215 | 2/1934 | United Kingdom | 415/170 A |

*Primary Examiner*—Robert E. Garrett
*Assistant Examiner*—Joseph M. Pitko
*Attorney, Agent, or Firm*—Hill, Van Santen, Steadman & Simpson

[57] ABSTRACT

A cooling arrangement is provided for the sealing members of a plastic bodied pump. The cooling arrangement comprises a metal cup-shaped member which is mounted to the pump housing to hold a stationary member of the seal. The metal member is exposed to the dry side of the seal and surrounds the drive shaft. A flinger, which may take the form of a disk, is carried on the shaft on the dry side of the seal closely adjacent to the exposed portion of the metal member to provide a localized air flow to assist in the cooling of the metal member, and thus, the seal members.

15 Claims, 1 Drawing Sheet

SEAL COOLING FOR PLASTIC PUMPS

BACKGROUND OF THE INVENTION

1. Field of the Invention

The present invention relates to plastic pumps and more particularly to a cooling arrangement for a sealing member utilized in a plastic pump.

2. Description of the Prior Art

In the construction of pump bodies, it has become desirable, as is the case with many other types of devices, to utilize plastic materials in lieu of conventional metal materials to effectuate cost savings for both material and fabrication labor, as well as to provide lighter weight pumps and to provide other benefits of plastic over metal such as resistance to corrosion. However, one benefit that metal has over plastic is that it is heat conductive. In a pump there is a mechanical seal which prevents a flow of pumped liquid between the pump chamber which generally is filled with liquid, and thus comprises a wet zone, and the outside of the pump body which comprises a dry zone. The seal usually comprises a rotating part and a stationary part, particularly in centrifugal pumps, and thus there is a heat build up due to the frictional rubbing of the seal stationary part against the rotating part. With conventional metal pump bodies, the heat would be dissipated through the pump housing itself, thus reducing or avoiding the problem of heat build up when there is no liquid within the pump body to dissipate the heat, that is, when the pump is not primed. However, with plastic pumps, the plastic pump body cannot dissipate the heat when the pump body is not filled with the liquid to be pumped and thus, there is a danger of damaging the seal due to heat build up.

U.S. Pat. No. 3,826,589 recognizes this problem and provides a solution of incorporating a metallic shield having a base secured to one of the plastic housing sections, and having the body of the shield extending outwardly within the wet zone of the pumping chamber so that it will extend into an area where water is trapped within the pumping chamber to provide the cooling necessary to prevent damage to the seal. However, the shield is held in a non rotating position, and if the water level within the pump housing is not at the level indicated, the necessary cooling may not be provided.

SUMMARY OF THE PRESENT INVENTION

The present invention provides a solution to the problem of over heating of the mechanical seal in a plastic pump when the pump is not primed and in fact when no liquid is in the pump body. The present invention provides for mounting the seal in a thin metal stamping which is exposed on the dry side of the seal. The metal stamping has a hole therethrough and is mounted around the motor shaft. Closely adjacent to the exposed stamping is a flinger which may comprise a thin disk mounted on the rotating motor shaft to provide localized air movement in the area of the exposed metal stamping sufficient to dissipate any heat build up in the metal stamping. The flinger, being constructed of a thin disk or a preferred embodiment, provides only a negligible load on the motor, as opposed to the load of a bladed fan, and thus the cooling is provided at virtually no energy cost.

DESCRIPTION OF THE PREFERRED EMBODIMENTS

Figure 1:
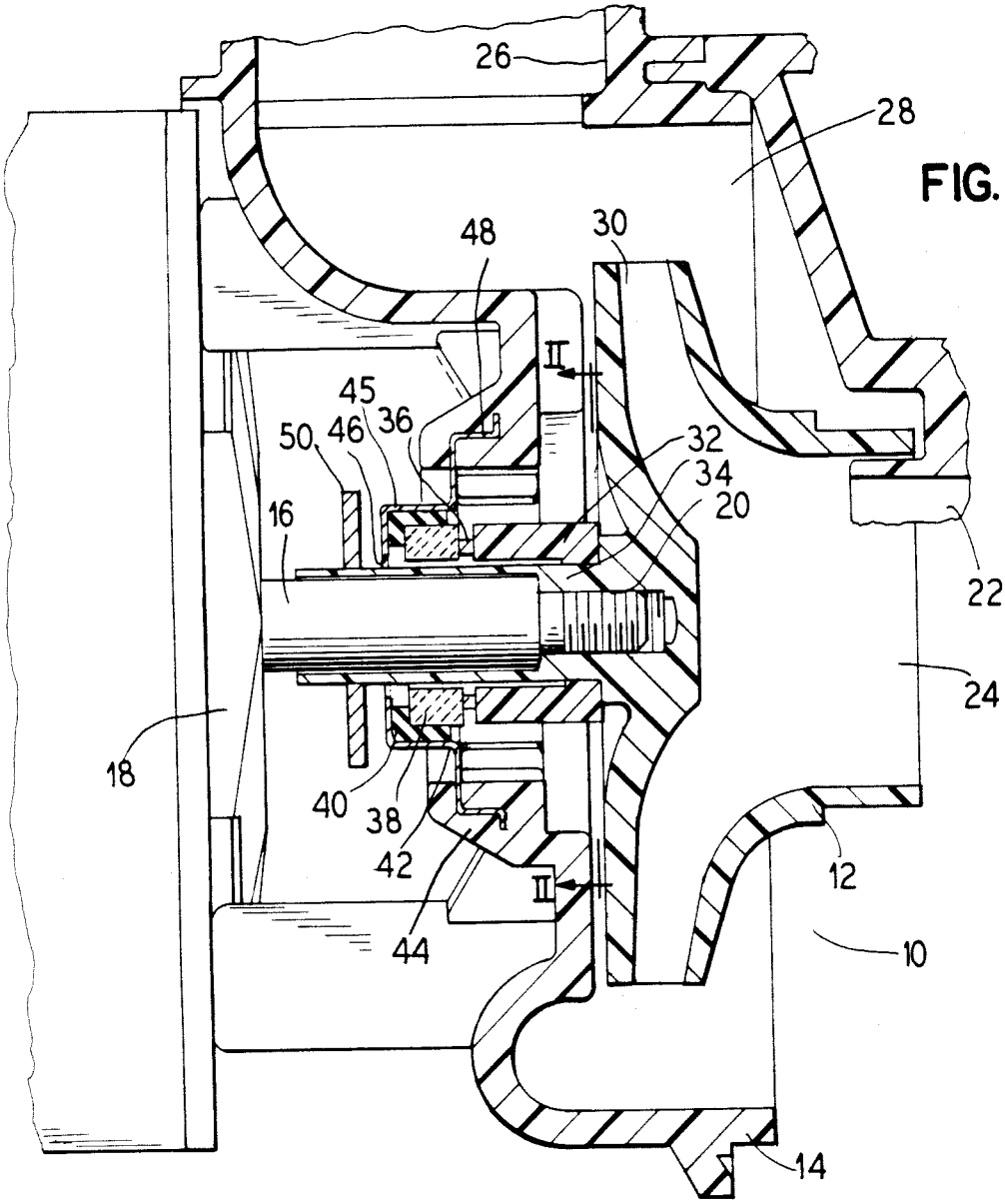
FIG. 1 is a side sectional view taken through a centrifugal pump embodying the principles of the present invention.
Figure 2:
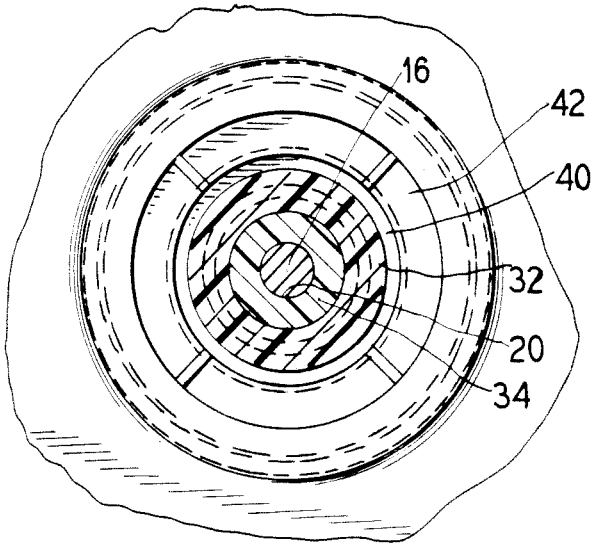
FIG. 2 is a sectional view taken generally along the lines II—II of FIG. 1.

In FIG. 1 there is generally illustrated a centrifugal pump in which a pump impeller 12 and a pump body 14 are fabricated of a plastic material. The pump 10 is mounted onto a rotating shaft 16 of an electric motor 18 by means of a threaded connection shown at 20. The pump body 14 has an inlet 22 extending into an eye 24 of the rotating impeller and has an outlet 26 in communication with a high pressure pumping chamber 28 communicating with the vanes 30 of the impeller. The high pressure pumping chamber 28 constitutes a wet zone within the pump since it is generally filled with the liquid being pumped.

To prevent the liquid being pumped from leaking from the high pressure chamber 28 (wet zone) into the area of the motor 18 along the rotating shaft 16 (desirably a dry zone), a mechanical seal arrangement is provided which is composed of a plurality of elements. A first element is a rotary part of the seal 32 which mounts onto a sleeve portion 34 of the impeller 12, such as by a press fit. This rotary seal member may be fabricated of a resilient material providing a function to be described in greater detail below.

Press fit into an axial end of the rotary part of the seal 32 is a carbon ring 36. This carbon ring rotates with the rotary part of the seal 32.

A ceramic ring 38 forms the next portion of the mechanical seal. The ceramic ring 38 is held stationary by means of a rubber boot or O-ring 40 into which the ceramic ring is press fit. The rubber boot or O-ring 40 is in turn press fit into a thin metal stamping 42 which is pressed or molded into a bracket portion 42 of the plastic housing 14.

Thus, there is a rotary frictional engagement between the carbon ring 36 and the ceramic ring 38. The rotary part of the seal 32, being a resilient material, provides a spring-like bias to continuously urge the carbon ring 36 into engagement with the ceramic ring. In this manner, an effective seal is provided between the carbon ring and ceramic ring 38.

However, if the pump is not primed and, therefore, there is not any liquid in the region of the contact area between the carbon ring and ceramic ring, as there normally would be since that area is in communication with the high pressure chamber 28, then an excessive heat build up would occur at this point when the impeller is spinning. The thin metal stamping 42 is provided to act as a heat sink and radiator to dissipate the heat build up of the seal. To accomplish this function, a portion 45 of the stamping 42 is exposed in the dry zone, outside the pump body. The rubber boot or O-ring 40 is sufficiently thin to transmit heat from the ceramic ring 38 to the metal stamping 42.

The metal stamping is cup shaped with an aperture or hole 46 therethrough permitting the stamping to receive the motor shaft 16 and impeller sleeve 34 therethrough. The ceramic ring 38 and rubber boot or O-ring 40 are held in a bottom portion of the stamping around the aperture 46 and on an opposite side of the exposed portion 45 of the stamping. An outer rim area 48 of the stamping is pressed or molded into the pump housing 14.

To assist in the heat dissipation, a flinger 50, preferably being a thin disk, is mounted on the motor shaft 16 or impeller sleeve 34 to rotate therewith thus causing an air flow closely adjacent to the exposed portion 45 of the metal stamping 42. This localized air flow is sufficient to dissipate any heat transmitted to the metal stamping. The flinger 50 is shown as being disk-shaped, which is the preferred embodiment, but the flinger could have a number of different shapes including, but not limited to spokes, fan blades, slotted disk, etc., such shapes being effective to cause a localized air flow when rapidly rotated on said drive shaft. Preferably, of course, the flinger 50 is merely a thin disk so that it does not result in a large air drag which would adversely affect the power consumption from the motor. Therefore, the localized air flow in the exposed area of the metal stamping 42 may be provided with effectively no energy costs.

Thus, it is seen that the present invention provides a solution to the problem of over heating of the seal even when there is no liquid in the pump body. The solution is provided with a minimal manufacturing cost and a negligible operating cost.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonable and properly come within the scope of my contribution to the art.

I claim as my invention:

1. In a centrifugal pump having a thermally non-conductive plastic pump body, a rotatable impeller mounted on a rotatable drive shaft, and a mechanical seal between said pump body and said drive shaft separating a dry zone from a wet zone and comprising a rotatable seal member and a non-rotatable seal member, a cooling arrangement for said mechanical seal comprising:

a thin metal thermally conductive stamping, cup shaped in configuration, having an outer rim held in an adjoining portion of the thermally non-conductive plastic pump body and having an inner periphery defined by an aperture through which said drive shaft extends, said inner periphery projecting away from said plastic pump body into an exposed position in the dry zone outside the pump body and surrounding the shaft, and means for connecting said stamping to said seal to provide a thermal flow path from said seal to said stamping, whereby, said stamping is thermally connected to said mechanical seal and operates as a heat sink and radiator to dissipate the heat buildup of the seal into the dry zone by radiation cooling.

2. A cooling arrangement according to claim 1, wherein said non-rotatable seal member is held in a bottom portion of said stamping around said aperture.

3. A cooling arrangement according to claim 2, wherein said non-rotatable seal member is a ceramic ring which is held in said stamping by means of a rubber boot or o-ring.

4. A cooling arrangement according to claim 1, wherein said stamping is secured to said pump body by a press fit between said outer rim portion with said pump body.

5. A cooling arrangement according to claim 1, wherein said stamping is secured to said pump body by molding said outer rim portion into said pump body.

6. A cooling arrangement according to claim 1 including a rotatable air flow flinger means rotatably driven in unison with the shaft and being disposed in the dry zone and spaced in air flow adjacency to the exposed projecting portion of the stamping thereby to produce a localized air flow for dissipating by convection heat transmitted to and radiated by the stamping.

7. A heat dissipation arrangement according to claim 6, wherein said flinger means is a disk-like member.

8. A cooling arrangement according to claim 7, wherein said impeller has a sleeve portion extending along said drive shaft and said disk-like member is mounted about said drive shaft by a press fit onto said impeller sleeve.

9. A cooling arrangement according to claim 7, wherein said disk-like member is mounted directly on said drive shaft.

10. In a centrifugal pump having a thermally non-conductive plastic pump body, a rotatable impeller mounted on a drive shaft rotatable about an axis, and a mechanical seal between said pump body and said drive shaft separating a dry zone from a wet zone and comprising a rotatable seal member and a non-rotatable seal member, a cooling arrangement for said mechanical seal comprising:

a thermally conductive heat dissipation member, having a radially outer portion held in an adjoining portion of the thermally non-conductive plastic pump body and having a radially inner portion defined by an aperture through which said drive shaft extends, said inner portion projecting away from said plastic pump body into an exposed position in the dry zone outside the pump body and surrounding the shaft, and means for connecting said heat dissipation member to said seal to provide a thermal flow path from said seal to said dissipation member, whereby, said heat dissipation member is thermally connected to said mechanical seal and operates as a heat sink and radiatior to dissipate the heat buildup of the seal into the dry zone by radiation.

11. A heat dissipation arrangement according to claim 10, wherein said heat dissipation member is a thin metal stamping.

12. A cooling arrangement according to claim 10 including a rotatable air flow flinger means rotatably driven in unison with the shaft and being disposed in the dry zone and spaced in air flow adjacency to the exposed projecting portion of the heat dissipation member thereby to produce a localized air flow for dissipating by convection heat transmitted to and radiated by the heat dissipation member.

13. A cooling arrangement according to claim 10 including means for providing air flow across said exposed portion of said heat dissipation member to dissipate heat build up of the seal by convection as well as by radiation.

14. In a centrifugal pump having a thermally non-conductive plastic pump body, a rotatable impeller mounted on a rotatable drive shaft, and a mechanical seal between said pump body and said drive shaft separating a dry zone from a wet zone and comprising a rotatable seal member and a non-rotatable seal member, a cooling arrangement for said mechanical seal comprising:

a thin metal thermally conductive stamping, cup shaped in configuration, having an outer rim held in an adjoining portion of the thermally non-conductive plastic pump body and having an inner periphery defined by an aperture through which said drive shaft extends, said inner periphery projecting away from said plastic pump body into an exposed position in the dry zone outside the pump body and surrounding the shaft, and a retaining member positioned between said stamping and said non-rotatable seal member sufficiently thin so as to transfer heat from said non-rotatable seal member to said stamping, whereby, said stamping is thermally connected to said mechanical seal and operates as a heat sink and radiator to dissipate the heat buildup of the seal into the dry zone by radiation cooling.

15. In a centrifugal pump having a thermally non-conductive plastic pump body, a rotatable impeller mounted on a drive shaft rotatable about an axis, and a mechanical seal between said pump body and said drive shaft separating a dry zone from a wet zone and comprising a rotatable seal member and a non-rotatable seal member, a cooling arrangement for said mechanical seal comprising:

a thermally conductive heat dissipation member, having a radially outer portion held in an adjoining portion of the thermally non-conductive plastic pump body and having a radially inner portion defined by an aperture through which said drive shaft extends, said inner portion projecting away from said plastic pump body into an exposed position in the dry zone outside the pump body and surrounding the shaft, and a retaining member positioned between said heat dissipation member and said non-rotatable seal member sufficiently thin so as to transfer heat from said non-rotatable seal member to said stamping, whereby, said heat dissipation member is thermally connected to said mechanical seal and operates as a heat sink and radiator to dissipate the heat buildup of the seal into the dry zone by radiation.

* * * * *